US011668208B2

(12) United States Patent
Tsuchiya

(10) Patent No.: US 11,668,208 B2
(45) Date of Patent: Jun. 6, 2023

(54) POSITIONING METHOD OF ARC-LIKE MEMBER AND POSITIONING JIG

(71) Applicant: Mitsubishi Power, Ltd., Kanagawa (JP)

(72) Inventor: Yohei Tsuchiya, Kanagawa (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 231 days.

(21) Appl. No.: 17/257,117

(22) PCT Filed: Aug. 8, 2019

(86) PCT No.: PCT/JP2019/031414
§ 371 (c)(1),
(2) Date: Dec. 30, 2020

(87) PCT Pub. No.: WO2020/036120
PCT Pub. Date: Feb. 20, 2020

(65) Prior Publication Data

US 2021/0131309 A1 May 6, 2021

(30) Foreign Application Priority Data

Aug. 17, 2018 (JP) ..... JP2018-153573

(51) Int. Cl.
*F01D 25/28* (2006.01)
*F01D 25/24* (2006.01)
*F01D 9/04* (2006.01)

(52) U.S. Cl.
CPC ..... *F01D 25/246* (2013.01); *F01D 25/243* (2013.01); *F01D 25/285* (2013.01);
(Continued)

(58) Field of Classification Search
CPC ..... F01D 25/28; F01D 25/285; F01D 25/246; F01D 25/243; F01D 25/265;
(Continued)

(56) References Cited

U.S. PATENT DOCUMENTS 8,142,150 B2 * 3/2012 Frick ..... F01D 25/24 415/214.1
2010/0038835 A1 * 2/2010 Horiuchi ..... F01D 25/285 269/47

(Continued)

FOREIGN PATENT DOCUMENTS

JP 55-39484 10/1980
JP 56-47515 11/1981

(Continued)

OTHER PUBLICATIONS

International Search Report dated Oct. 29, 2019 in International Application No. PCT/JP2019/031414 with English-language translation.

(Continued)

*Primary Examiner* — Eldon T Brockman
*Assistant Examiner* — Maxime M Adjagbe
(74) *Attorney, Agent, or Firm* — Wenderoth, Lind & Ponack, L.L.P.

(57) ABSTRACT

A positioning method of an arc-like member according to at least one embodiment of the present invention includes a step of moving a protruding part disposed at a circumferential end of the arc-like member in a radial direction with respect to a reference member positioned on a radially outer side as viewed from the circumferential end of the arc-like member. In the step of moving the protruding part, a wall portion is arranged on a radially outer side or a radially inner side with respect to the reference member, a jack is arranged between the wall portion and the reference member, and the jack is operated to move the protruding part with respect to the reference member by the pressing piece mounted on the wall portion via a rod.

11 Claims, 14 Drawing Sheets

(52) U.S. Cl.
CPC ..... *F01D 9/041* (2013.01); *F05D 2220/31* (2013.01); *F05D 2240/12* (2013.01); *F05D 2240/14* (2013.01); *F05D 2260/30* (2013.01)

(58) Field of Classification Search
CPC ..... F01D 2220/31; F05D 2260/30; F05D 2230/64; B25B 11/02
See application file for complete search history.

(56) References Cited

U.S. PATENT DOCUMENTS

| | | | |
|---|---|---|---|
| 2010/0226770 | A1 | 9/2010 | Frick et al. |
| 2013/0230392 | A1 | 9/2013 | Hashimoto |
| 2015/0168139 | A1 | 6/2015 | Matlapudi |

FOREIGN PATENT DOCUMENTS

| | | |
|---|---|---|
| JP | 60-135396 | 7/1985 |
| JP | 1-288598 | 11/1989 |
| JP | 2010-209910 | 9/2010 |
| JP | 2012-13046 | 1/2012 |
| JP | 2013-181503 | 9/2013 |
| JP | 2015-114333 | 6/2015 |

OTHER PUBLICATIONS

International Preliminary Report on Patentability dated Mar. 4, 2021 in International Application No. PCT/JP2019/031414 with English-language translation.

* cited by examiner

POSITIONING METHOD OF ARC-LIKE MEMBER AND POSITIONING JIG

TECHNICAL FIELD

The present disclosure relates to a positioning method of an arc-like member and a positioning jig.

BACKGROUND

Like a blade ring in a gas turbine or a steam turbine, an intermediate shaft cover in the gas turbine, or the like, an arc-like member disposed inside a casing of the turbine is divided into, for example, an upper half portion and a lower half portion, and is united by combining the upper half portion and the lower half portion.

For example, a seal ring is attached to the inner surface of the blade ring. A gap between the inner surface of the seal ring and a tip of a rotor blade mounted on a rotor or between a surface of the rotor and a tip of a stator vane mounted on the blade ring is generally very narrow as 1 to 2 mm, in order to improve thermal efficiency. In disassembly and assembly of a turbine casing, it is necessary to measure not only the above-described gap but also a gap between the rotor blade and the stator vane in a rotor shaft direction, and to control whether these gaps are secured during operation.

Such an arc-like member may be deformed due to, for example, deflection by the own weight. If the arc-like member is deformed, for example, the gap between the inner surface of the seal ring and the tip of the rotor blade mounted on the rotor or between the surface of the rotor and the tip of the stator vane mounted on the blade ring is changed. Even if a gap between a stationary part and a rotational part is measured in this state, the measured gap is different from a gap during operation, obtaining a wrong measurement value.

Thus, the deformation in the arc-like member is suppressed by using a jig (see Patent Document 1).

The jig described in Patent Document 1 includes a load application device moving back and forth in the radial direction of a blade ring toward a load receiving member fixed to a lower half portion of the blade ring. The jig described in Patent Document 1 is configured to apply a load radially inward of the blade ring, from a perfect circle holding jig fixed to a joint surface of a lower half portion of a casing to the load receiving member via the load application device.

More specifically, the load application device includes a screw shaft fixed to the perfect circle holding jig toward the load receiving member, a nut screwed into the screw shaft, and a push-in head loosely fitted to a tip of the screw shaft to be movable, and is configured to apply the load radially inward of the blade ring to the load receiving member, by moving the push-in head toward the load receiving member by the nut.

CITATION LIST

Patent Literature

Patent Document 1: JP2012-13046A

SUMMARY

Technical Problem

However, in the jig described in Patent Document 1, a force required to rotate the nut increases as the load applied to the load receiving member increases, making it difficult to move the blade ring to a desired position.

In view of the above, an object of at least one embodiment of the present invention is to easily perform positioning of the arc-like member.

Solution to Problem (1) A positioning method of an arc-like member according to at least one embodiment of the present invention includes a step of moving a protruding part disposed at a circumferential end of the arc-like member in a radial direction with respect to a reference member positioned on a radially outer side as viewed from the circumferential end of the arc-like member. In the step of moving the protruding part, a first wall portion and a second wall portion connected to each other are arranged, such that the reference member is positioned between the first wall portion and the second wall portion, the jack is arranged between the reference member and one of the first wall portion or the second wall portion, and the jack is operated to move the protruding part with respect to the reference member by the pressing piece mounted on the first wall portion via the rod.

With the above method (1), since the jack is operated to move the protruding part with respect to the reference member by the pressing piece mounted on the first wall portion via the rod, positioning of the arc-like member is easily performed.

Moreover, with the above method (1), depending on whether the jack is arranged between the first wall portion and the reference member or whether the jack is arranged between the second wall portion and the reference member in the jack accommodation space, it is possible to change whether the pressing piece is moved to the radially inner side or moved to the radially outer side. Thus, it is possible to move the protruding part to both of the radially inner side and the radially outer side with respect to the reference member.

(2) In some embodiments, in the above method (1), in the step of moving the protruding part, the jack is arranged between the first wall portion and the reference member in the jack accommodation space, the pressing piece is arranged on the radially outer side of the protruding part, and the jack is operated to move the protruding part toward the radially inner side with respect to the reference member by the pressing piece mounted on the first wall portion via the rod.

With the above method (2), it is possible to move the protruding part toward the radially inner side with respect to the reference member.

(3) In some embodiments, in the above method (1), in the step of moving the protruding part, the jack is arranged between the second wall portion and the reference member in the jack accommodation space, the pressing piece is arranged on the radially inner side of the protruding part, and the jack is operated to move the protruding part toward the radially outer side with respect to the reference member by the pressing piece mounted on the first wall portion via the rod.

With the above method (3), it is possible to move the protruding part toward the radially outer side with respect to the reference member.

(4) In some embodiments, in any one of the above methods (1) to (3), in the step of moving the protruding part, the jack is arranged in the jack accommodation space such that a center axis of the rod overlaps at least a part of a piston for the jack, as viewed from an extending direction of the rod.

With the above method (4), it is possible to efficiently transmit a pressing force of the jack to the pressing piece.

(5) In some embodiments, in any one of the above methods (1) to (4), in the step of moving the protruding part, a distance between the first wall portion and the pressing piece is adjusted by adjusting a length of protrusion of the rod from the first wall portion to the radially inner side, before the jack is operated to move the protruding part with respect to the reference member by the pressing piece mounted on the first wall portion via the rod.

With the above method (5), it is possible to arrange the pressing piece at a desired position by adjusting the distance between the first wall portion and the pressing piece, even if a distance between the protruding part and the reference member is changed by, for example, deformation in the arc-like member.

(6) A positioning jig according to at least one embodiment of the present invention includes a rod, a pressing piece mounted on one end portion of the rod, a first wall portion mounted on another end portion of the rod, and a second wall portion positioned opposite to the rod across the first wall portion in an axial direction of the rod, and connected to the first wall portion. The first wall portion and the second wall portion form a jack accommodation space between the first wall portion and the second wall portion in the axial direction.

With the above configuration (6), arranging the jack and the reference member in the jack accommodation space, and operating the jack to move the first wall portion and the second wall portion with respect to the reference member, it is possible to move the pressing piece mounted on the first wall portion via the rod along the extending direction of the rod. Thus, it is possible to press a pressing object by the pressing piece with a driving force generated by the jack, and to easily perform positioning of the pressing object with respect to the reference member.

Moreover, with the above configuration (6), arranging the jack between the first wall portion and the reference member or arranging the jack between the second wall portion and the reference member in the jack accommodation space, it is possible to change a moving direction of the pressing piece to either direction of two directions along the axial direction of the rod. Thus, it is possible to move the pressing object with respect to the reference member in either direction of the above-described two directions.

(7) In some embodiments, in the above configuration (6), the pressing piece is configured to be detachable with respect to the rod.

With the above configuration (7), the pressing piece and the rod are arranged easily, for example, the pressing piece and the rod can be arranged in a narrow place, as compared with a case in which the pressing piece is not configured to be detachable with respect to the rod.

(8) In some embodiments, in the above configuration (7), the rod includes a first engagement portion engaged with the pressing piece mounted on the first wall portion via the rod, in a case in which the jack arranged in the jack accommodation space is operated to move a pressing object toward a direction away from a reference member positioned in the jack accommodation space by the pressing piece, and a second engagement portion engaged with the pressing piece mounted on the first wall portion via the rod, in a case in which the jack arranged in the jack accommodation space is operated to move the pressing object toward a direction close to the reference member positioned in the jack accommodation space by the pressing piece.

With the above configuration (8), it is possible to use the above-described rod regardless of whether the moving direction of the pressing object is the direction away from the reference member or the direction close to the reference member, making it possible to suppress a cost of the positioning jig.

(9) In some embodiments, in the above configuration (8), the pressing piece includes a pressing recess formed in a surface abutting on the pressing object, engages the surface toward a side of the one end portion when engaged with the first engagement portion, and engages the surface toward a side of the another end portion when engaged with the second engagement portion.

With the above configuration (9), it is possible to press the pressing object by the pressing recess in both of the case in which the pressing object is moved toward the direction away from the reference member and the case in which the pressing object is moved toward the direction close to the reference member, stabilizing the attitude of the pressing piece and making it possible to stably press the pressing object.

(10) in some embodiments, in any one of the above configurations (6) to (9), the positioning jig further includes a jack position defining member for arranging the jack in the jack accommodation space such that a center axis of the rod overlaps at least a part of a piston for the jack, as viewed from an extending direction of the rod.

With the above configuration (10), it is possible to efficiently transmit a pressing force of the jack to the pressing piece.

(11) In some embodiments, in any one of the above configuration (6) to (10), the positioning jig further includes an adjustment part for adjusting a length of protrusion of the rod from the first wall portion to the axial direction.

With the above method (11), it is possible to arrange the pressing piece at a desired position by adjusting the length of protrusion of the rod to the axial direction, that is, the distance between the first wall portion and the pressing piece, in accordance with the distance between the pressing object and the reference member.

Advantageous Effects

According to at least one embodiment of the present invention, it is possible to easily perform positioning of an object.

DETAILED DESCRIPTION

Figure 1:
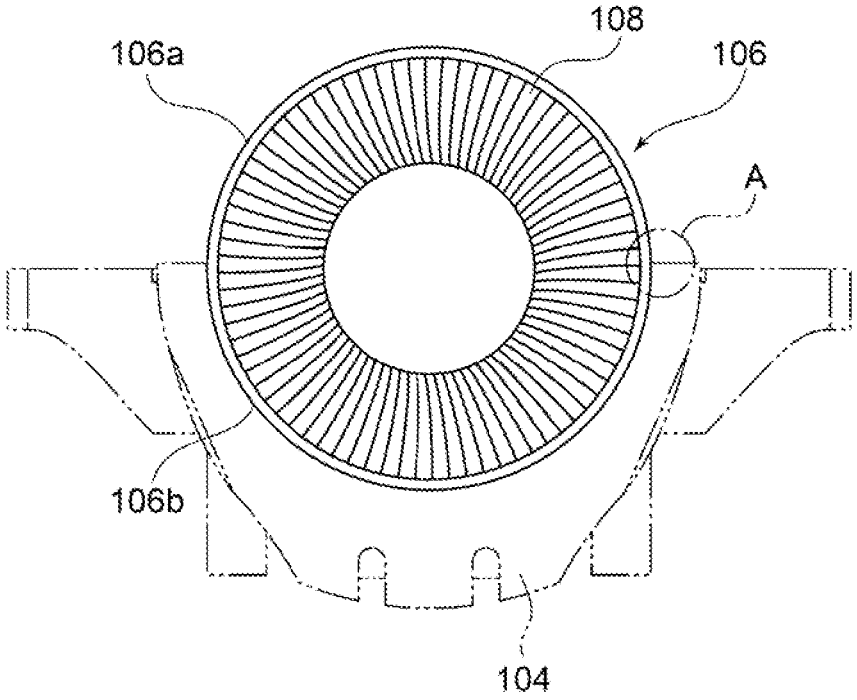
FIG. 1 is a transverse cross-sectional view of a steam turbine casing.

Some embodiments of the present invention will be described below with reference to the accompanying drawings. It is intended, however, that unless particularly identified, dimensions, materials, shapes, relative positions and the like of components described in the embodiments or shown in the drawings shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, the expressions "comprising", "including", "having", "containing", and "constituting" one constituent component are not exclusive expressions that exclude the presence of other constituent components.

FIG. 1 is a transverse cross-sectional view of a steam turbine casing as an example of a device to which a positioning method of an arc-like member and a positioning jig are applicable according to an embodiment. FIG. 1 shows a state in which an external casing upper half portion and an internal casing upper half portion are dismounted. In the turbine casing, the external casing, the internal casing, and a blade ring are each vertically divided into two pieces, and the two pieces are joined by a bolt or the like on respective joint surfaces. In FIG. 1, a ring-shaped blade ring 106 is arranged on the inner side of an internal casing 104.

The blade ring 106 is supported by the internal casing 104 via a support mechanism (not shown). On the inner side of the blade ring 106, a number of stator vanes 108 are arranged along the inner surface of the blade ring, and a plurality of rows of the stator vanes 108 are mounted in a rotor shaft direction as well. The casing, the blade ring, the stator vanes, and the like constitute a stationary part. On the inner side of the stator vanes, a rotor (not shown) where a rotor blade is mounted is arranged, and the rotor is arranged such that the rotor blade is positioned between the stator vanes. The rotor blade and the rotor constitute a rotational part.

The blade ring 106 is formed to be divided into a blade ring upper half portion 106*a* and a blade ring lower half portion 106*b* each having a semi-ring shape. The blade ring upper half portion 106*a* and the blade ring lower half portion 106*b* are coupled by a bolt with a flangeless method in a state in which their joint surfaces are joined.

The turbine casing is disassembled by a procedure in which an external casing upper half portion, an internal casing upper half portion, and the blade ring upper half portion are dismounted sequentially from outer side, and the rotor is dismounted lastly. In assembly, the respective parts are assembled by a reverse procedure to that of disassembly. A seal ring is attached to the inner surface of the blade ring. A gap between the inner surface of the seal ring and a tip of the rotor blade mounted on the rotor or between a surface of the rotor and a tip of each of the stator vanes mounted on the blade ring is generally very narrow as 1 to 2 mm, in order to improve thermal efficiency. In disassembly and assembly of the turbine casing, it is necessary to measure not only the above-described gap but also a gap between the rotor blade and each of the stator vanes in the rotor shaft direction, and to control whether these gaps are secured during operation.

Figure 2:
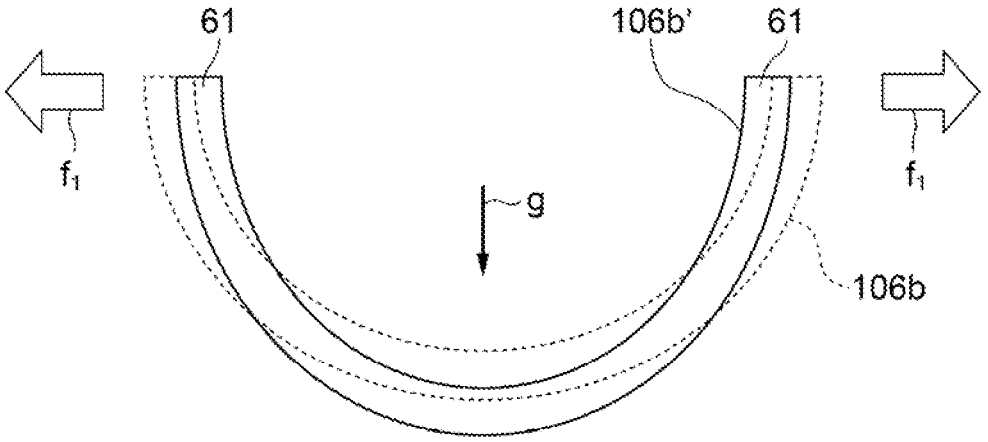
FIG. 2 is an explanatory view showing an example of a deformation state of a blade ring lower half portion when a blade ring upper half portion is dismounted.

If the blade ring upper half portion 106*a* is dismounted in disassembly of the turbine casing, as shown in FIG. 2, the blade ring lower half portion 106*b* loses a hitherto force balance and by a own weight g, oval deformation occurs in which both ends (circumferential ends) 61 curve inward as indicated by a solid line 106*b*', from a perfect circular state indicated by a dashed line 106*b*. Even if a gap between the stationary part and the rotational part is measured in this state, the measured gap is different from a gap during operation, obtaining a wrong measurement value.

Moreover, the gap between the inner surface of the blade ring and the tip of the rotor blade mounted on the rotor or between the surface of the rotor and the tip of the stator vane mounted on the blade ring is intrinsically minute gap, and thus a situation may occur in which the inner surface of the blade ring and the tip of the rotor blade or the surface of the rotor and the tip of the stator vane contact each other. Further, due to the contact, a contact portion may suffer breakage.

Furthermore, if the circumferential end 61 of the blade ring lower half portion 106*b* and the circumferential end of the blade ring upper half portion 106*a* are misaligned due to the oval deformation in the blade ring lower half portion 106*b*, a stud mounted on the circumferential end 61 of the blade ring lower half portion 106*b* and a stud hole at the circumferential end of the blade ring upper half portion 106*a* are misaligned, making it difficult to mount the blade ring upper half portion 106*a* in assembly of the turbine casing.

In order to eliminate such failures, the perfect circular state (the state indicated by the dashed line 106*b*) during operation needs to be reproduced by applying an outward pull force f1 to the circumferential end of the blade ring lower half portion to perform positioning of the circumferential end 61 of the blade ring lower half portion 106*b*.

Figure 3:
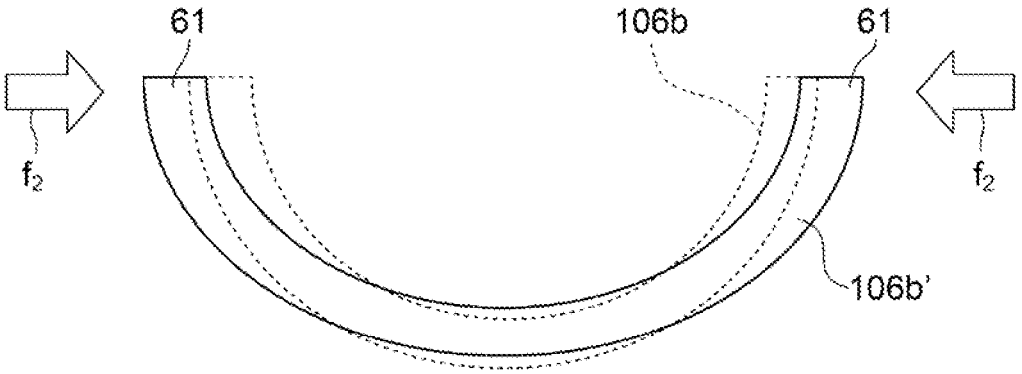
FIG. 3 is an explanatory view showing another example of the deformation state of the blade ring lower half portion when the blade ring upper half portion is dismounted.

Moreover, in some cases, depending on a balance of a force acting on the turbine casing, a force of expanding the circumferential end 61 of the blade ring lower half portion 106*b* outward may be applied. In this case, as indicated by the solid line 106*b*' in FIG. 3, deformation may occur in which the both ends expand outward after the blade ring upper half portion 106*a* is dismounted. Thus, the perfect circular state during operation needs to be restored by applying an inward force f2 to the circumferential end 61 of the blade ring lower half portion 106*b* to perform positioning of the circumferential end 61 of the blade ring lower half portion 106*b*.

Thus, using the positioning jig according to some embodiments to be described below, positioning of the circumferential end 61 of the blade ring lower half portion 106*b* is performed. Hereinafter, the positioning jig according to some embodiments will be described in detail.

(Positioning Jig 100)

Figure 4:
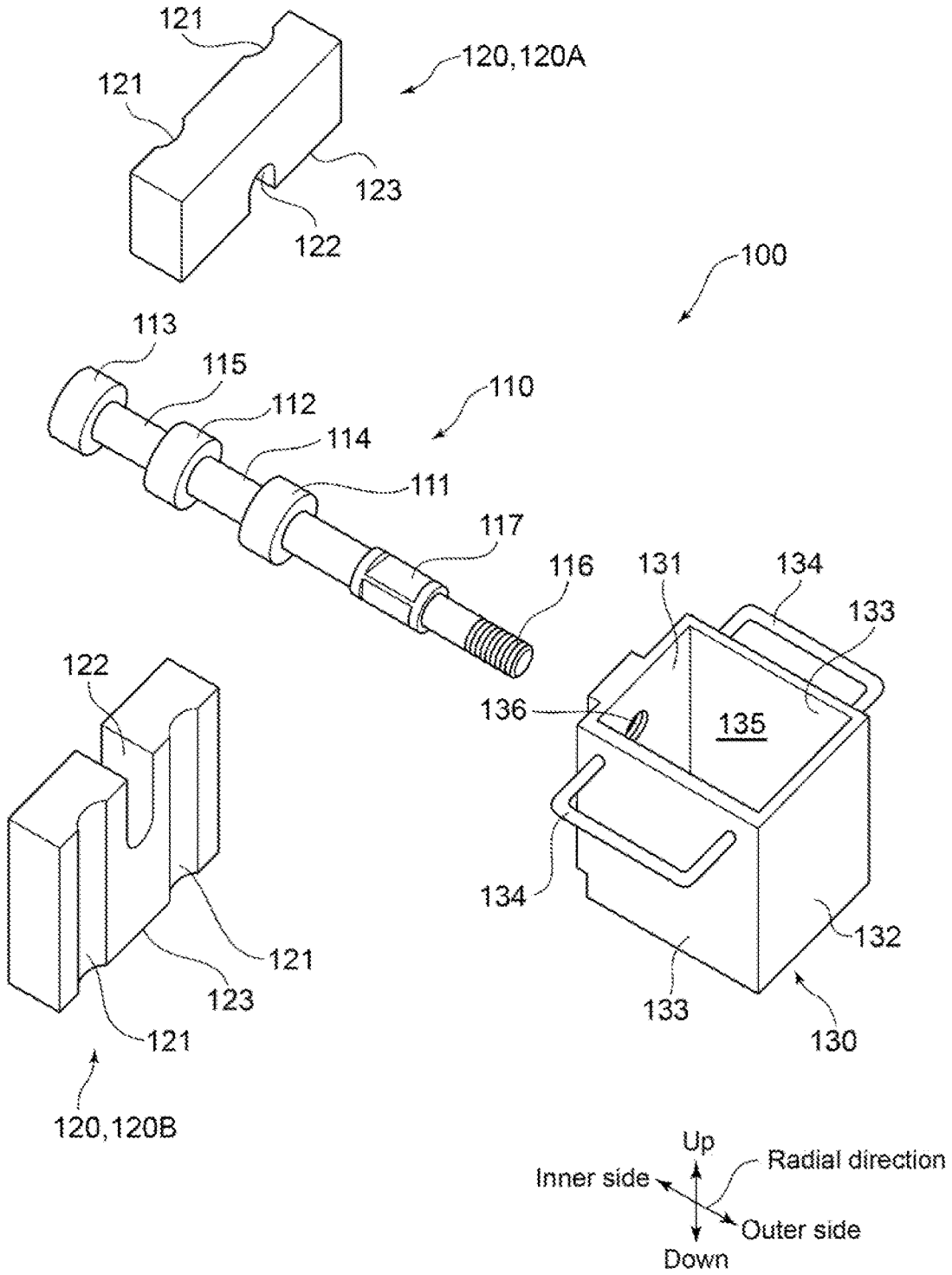
FIG. 4 is an exploded view of a positioning jig according to some embodiments.

FIG. 4 is an exploded view of a positioning jig according to some embodiments. A positioning jig 100 according to some embodiments includes a rod 110, a pressing piece 120, and a sleeve 130. For the descriptive convenience, each direction is defined with reference to an attitude in a usage state to be described later of the positioning jig 100. More specifically, an extending direction of the rod 110 is oriented in substantially the same direction of the radial direction of the turbine casing, that is, the radial direction of the blade ring lower half portion 106*b* having an arc shape, and thus may simply be referred to as the radial direction.

Depending on a usage condition of the positioning jig 100, a difference may occur between the extending direction of the rod 110 and the radial direction of the blade ring lower half portion 106*b*. However, in the description below, the extending direction of the rod 110 may simply be referred to as the radial direction, for convenience.

Moreover, an up-down direction illustrated in FIG. 4 is oriented in the same direction as the up-down direction of the turbine casing, and is thus simply referred to as the up-down direction.

The rod 110 according to some embodiments includes a first large diameter portion 111, a second large diameter portion 112, a third large diameter portion 113, a first engagement portion 114, a second engagement portion 115, a male screw portion 116, and a prismatic portion 117. In the rod 110 according to some embodiments, a radially inner side may be referred to as one end side, and a radially outer side may be referred to as another end side.

In the rod 110 according to some embodiments, the first large diameter portion 111, the first engagement portion 114, the second large diameter portion 112, the second engagement portion 115, and the third large diameter portion 113 are formed in this order from the radially outer side, that is, the another end side.

The first large diameter portion 111, the second large diameter portion 112, and the third large diameter portion 113 have diameters larger than those of the first engagement portion 114 and the second engagement portion 115, respectively.

The first engagement portion 114 and the second engagement portion 115 are portions each in which the corresponding pressing piece 120 to be described later is engaged. A portion of the rod 110 where the first engagement portion 114 and the second engagement portion 115 are formed may be referred to as one end portion.

The male screw portion 116 is a male screw portion formed toward the radially inner side from an end on the radially outer side. A portion of the rod 110 where the male screw portion 116 is formed may be referred to as another end portion.

The prismatic portion 117 is a portion having a prismatic shape formed between the first large diameter portion 111 and the male screw portion 116. As will be described later, the prismatic portion 117 is a portion for a tool such as a spanner to be hanged when the rod 110 is mounted on the sleeve 130 or in order to adjust a protrusion distance of the rod 110 from the sleeve 130.

As will be described later, the pressing piece 120 according to some embodiments is a member configured to press protruding parts 62 disposed on the circumferential end 61 of the blade ring lower half portion 106*b*. The pressing piece 120 according to some embodiments includes pressing recesses 121 and an engagement groove 122.

Each of the protruding part 62 is a stud mounted on the circumferential end 61 of the blade ring lower half portion 106*b*.

As will be described later, the pressing recesses 121 are, respectively, portions abutting on the side surfaces of the protruding parts 62 disposed on the circumferential end 61 of the blade ring lower half portion 106*b*, when positioning of the circumferential end 61 of the blade ring lower half portion 106*b* is performed. The engagement groove 122 is a groove engaging with the first engagement portion 114 or the second engagement portion 115 of the rod 110.

The pressing piece 120 is configured to be detachable with respect to the rod 110.

The pressing piece 120 used in some embodiments is a first pressing piece 120A or a second pressing piece 120B. The first pressing piece 120A is used in a case in which the position of the circumferential end 61 is moved to the radially inner side. The second pressing piece 120B is used in a case in which the position of the circumferential end 61 is moved toward the radially outer side.

In the following description, in a case in which the first pressing piece 120A and the second pressing piece 120B need not be distinguished from each other in particular, the pressing piece is simply referred to as the pressing piece 120.

The sleeve 130 according to some embodiments includes a first wall portion 131 and a second wall portion 132 each serving as a wall portion, and connection portions 133.

The first wall portion 131 is a wall portion arranged on the radially inner side and includes a female screw portion 136 formed to be coupled to the male screw portion 116 of the rod 110, when the positioning jig 100 is used. That is, the another end portion of the rod 110 is mounted on the first wall portion 131.

The second wall portion 132 is a wall portion positioned opposite to the rod 110 across the first wall portion 131 in the radial direction, that is, the axial direction of the rod 110.

The connection portions 133 are portions for connecting the first wall portion 131 and the second wall portion 132. In the embodiment shown in FIG. 4, the connection portions 133 are a pair of wall portions arranged separately from each other. However, the form of the connection portions 133 is not limited to the form shown in FIG. 4, as long as the first wall portion 131 and the second wall portion 132 can be connected to each other. In the embodiment shown in FIG. 4, handles 134 for handling the sleeve 130 are mounted on the connection portions 133, respectively.

In the sleeve 130 according to some embodiments, the first wall portion 131 and the second wall portion 132 form a jack accommodation space 135 the first wall portion 131 and the second wall portion 132 in the radial direction, that is the axial direction of the rod 110.

With the positioning jig 100 according to some embodiments described above, as will be described later, arranging a jack 150 and a reference member 71 in the jack accommodation space 135 (see FIGS. 5 to 10), and operating the jack 150 to move the first wall portion 131 and the second wall portion 132 with respect to the reference member 71, it is possible to move the pressing piece 120 mounted on the first wall portion 131 via the rod 110 along the extending direction of the rod 110. Thus, it is possible to press a pressing object by the pressing piece 120 with a driving force generated by the jack 150, and to easily perform positioning of the pressing object with respect to the reference member 71.

Moreover, with the positioning jig 100 according to some embodiments described above, as will be described later, arranging the jack 150 between the first wall portion 131 and the reference member 71 or arranging the jack 150 between the second wall portion 132 and the reference member 71 in the jack accommodation space 135, it is possible to change a moving direction of the pressing piece 120 to either direction of two directions along the axial direction of the rod 110. Thus, it is possible to move the pressing object with respect to the reference member 71 in either direction of the above-described two directions.

In the positioning jig 100 according to some embodiments described above, since the pressing piece 120 is configured to be detachable with respect to the rod 110, the pressing piece 120 and the rod 110 are arranged easily, for example, the pressing piece 120 and the rod 110 can be arranged in a narrow place, as compared with a case in which the pressing piece 120 is not configured to be detachable with respect to the rod 110.

In the positioning jig 100 according to some embodiments described above, as will be described later, the first pressing piece 120A is engaged with the first engagement portion 114, in a case in which the jack 150 disposed in the jack accommodation space 135 is operated to move the pressing object toward a direction away from the reference member 71 disposed in the jack accommodation space 135 by the pressing piece 120 mounted on the first wall portion 131 via the rod 110.

Moreover, in the positioning jig 100 according to some embodiments described above, as will be described later, the second pressing piece 120B is engaged with the second engagement portion 115, in a case in which the jack 150 arranged in the jack accommodation space 135 is operated to move the pressing object toward a direction close to the reference member 71 positioned in the jack accommodation space 135 by the pressing piece 120 mounted on the first wall portion 131 via the rod 110.

Thus, it is possible to use the above-described rod 110 regardless of whether the moving direction of the pressing object is the direction away from the reference member 71 or the direction close to the reference member 71, making it possible to suppress a cost of the positioning jig.

(Positioning Method of Circumferential End 61)

Hereinafter, a positioning method of the circumferential end 61 using the positioning jig 100 according to some embodiments described above will be described.

Figure 5:
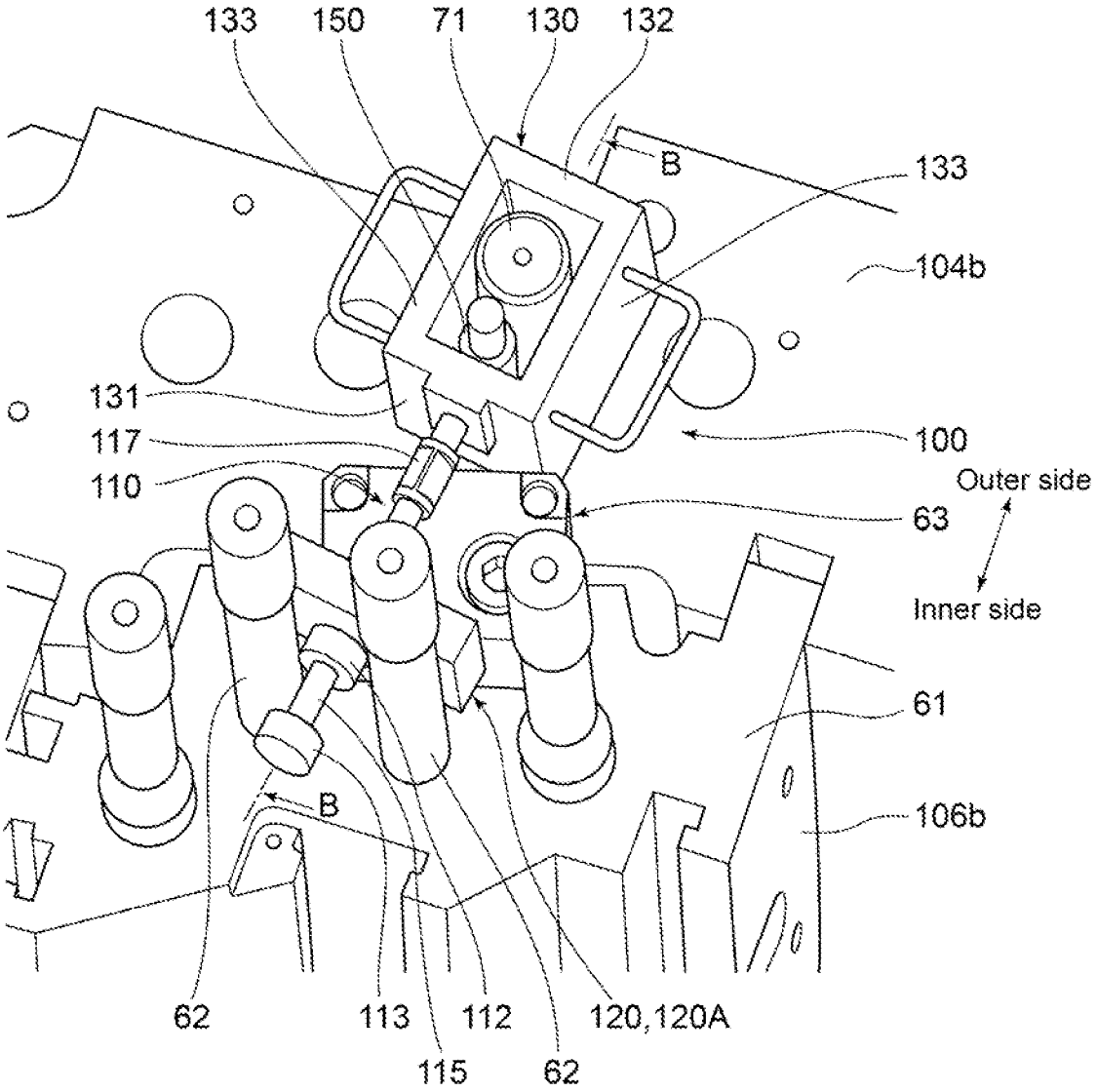
FIG. 5 is a perspective view showing a state in which positioning of a circumferential end is performed by using the positioning jig according to some embodiments.
Figure 6:
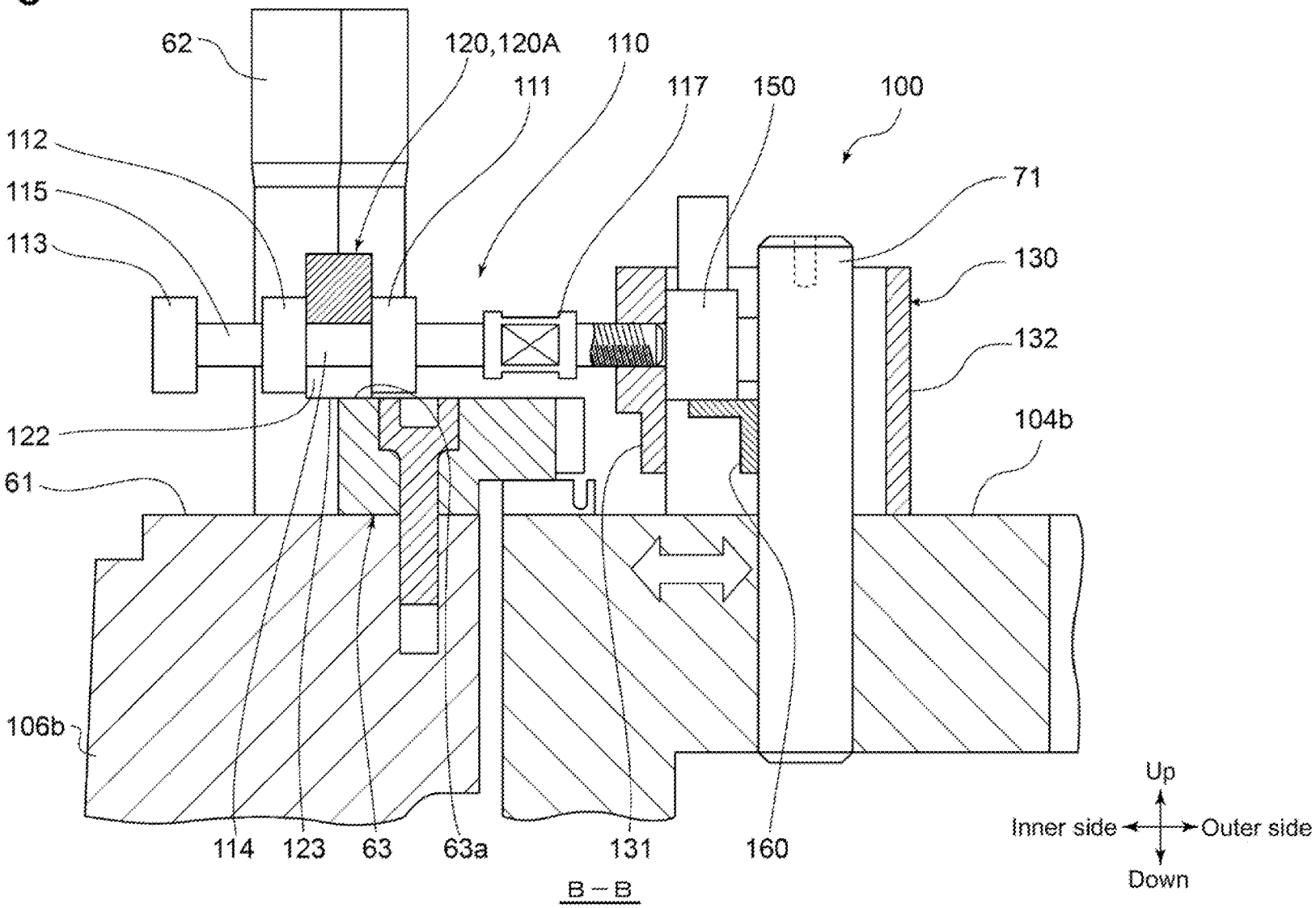
FIG. 6 is a cross-sectional view taken along line B-B in FIG. 5.
Figure 7:
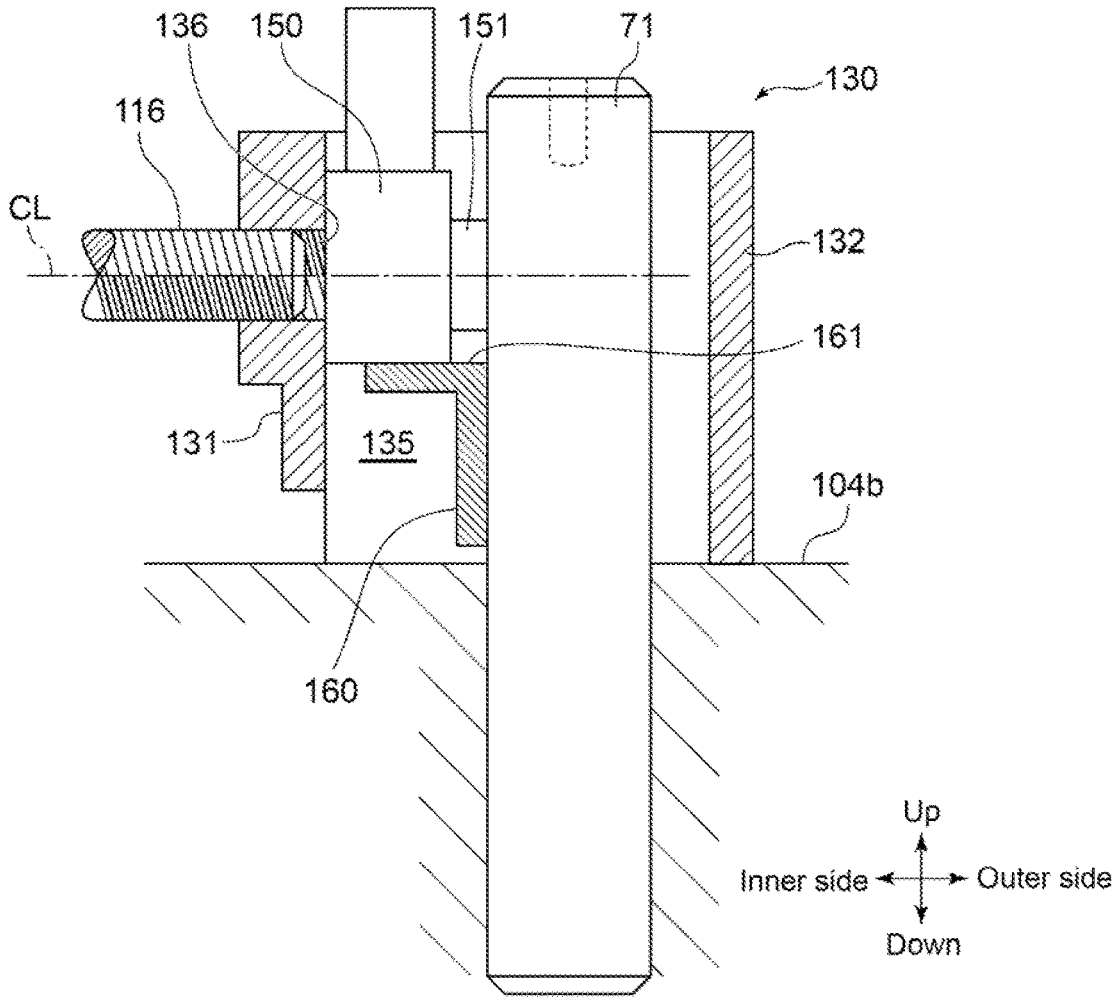
FIG. 7 is a view showing an arrangement state of a jack in FIG. 6.

FIG. 5 is a perspective view showing a state in which positioning of the circumferential end 61 is performed by using the positioning jig 100 according to some embodiments. FIG. 6 is a cross-sectional view taken along line B-B in FIG. 5. FIG. 7 is a view showing an arrangement state of the jack in FIG. 6. FIGS. 5 to 7 are views for describing the case in which the position of the circumferential end 61 is moved toward a radially inner side.

Figure 8:
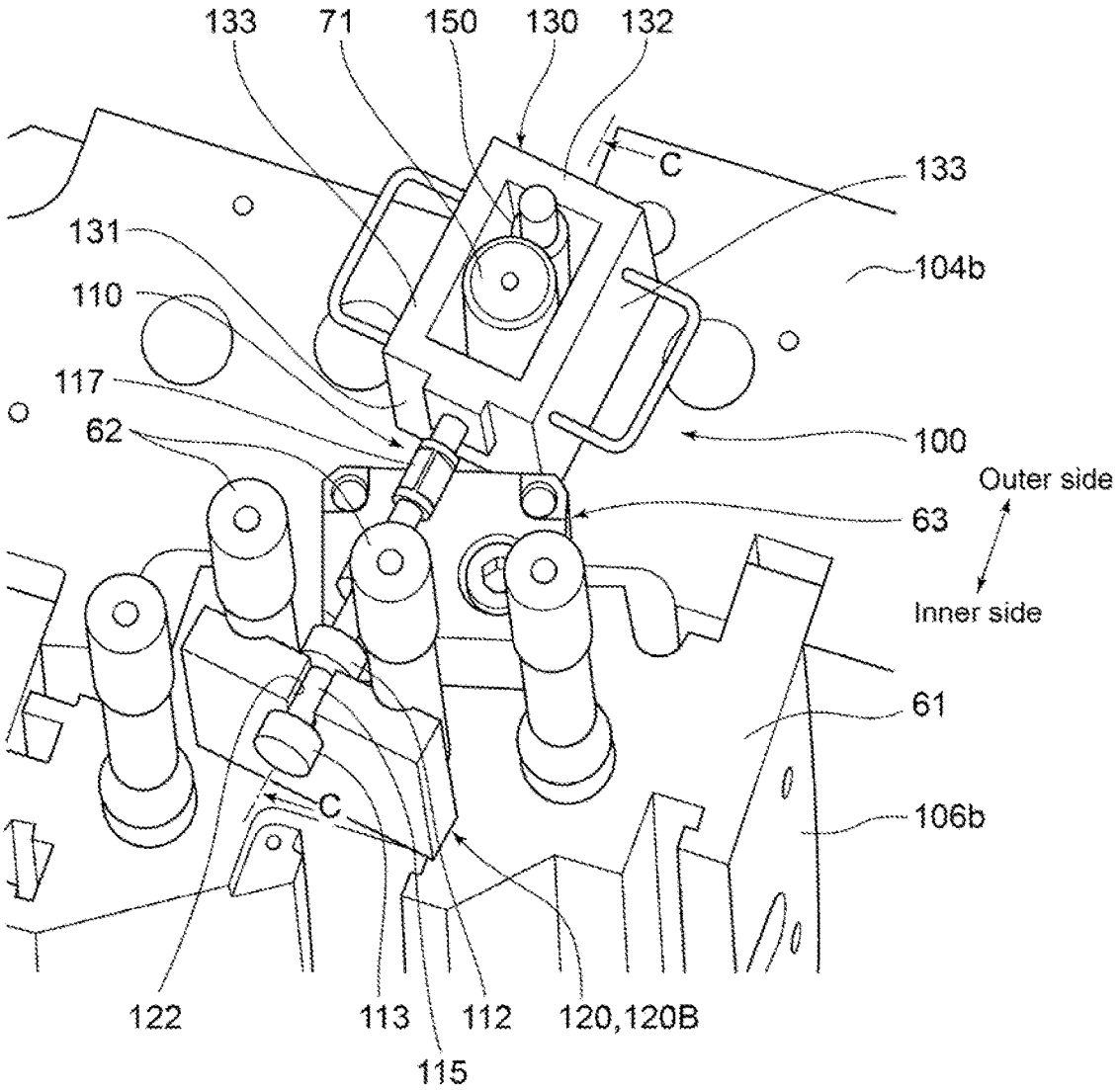
FIG. 8 is a perspective view showing a state in which positioning of the circumferential end is performed by using the positioning jig according to some embodiments.
Figure 9:
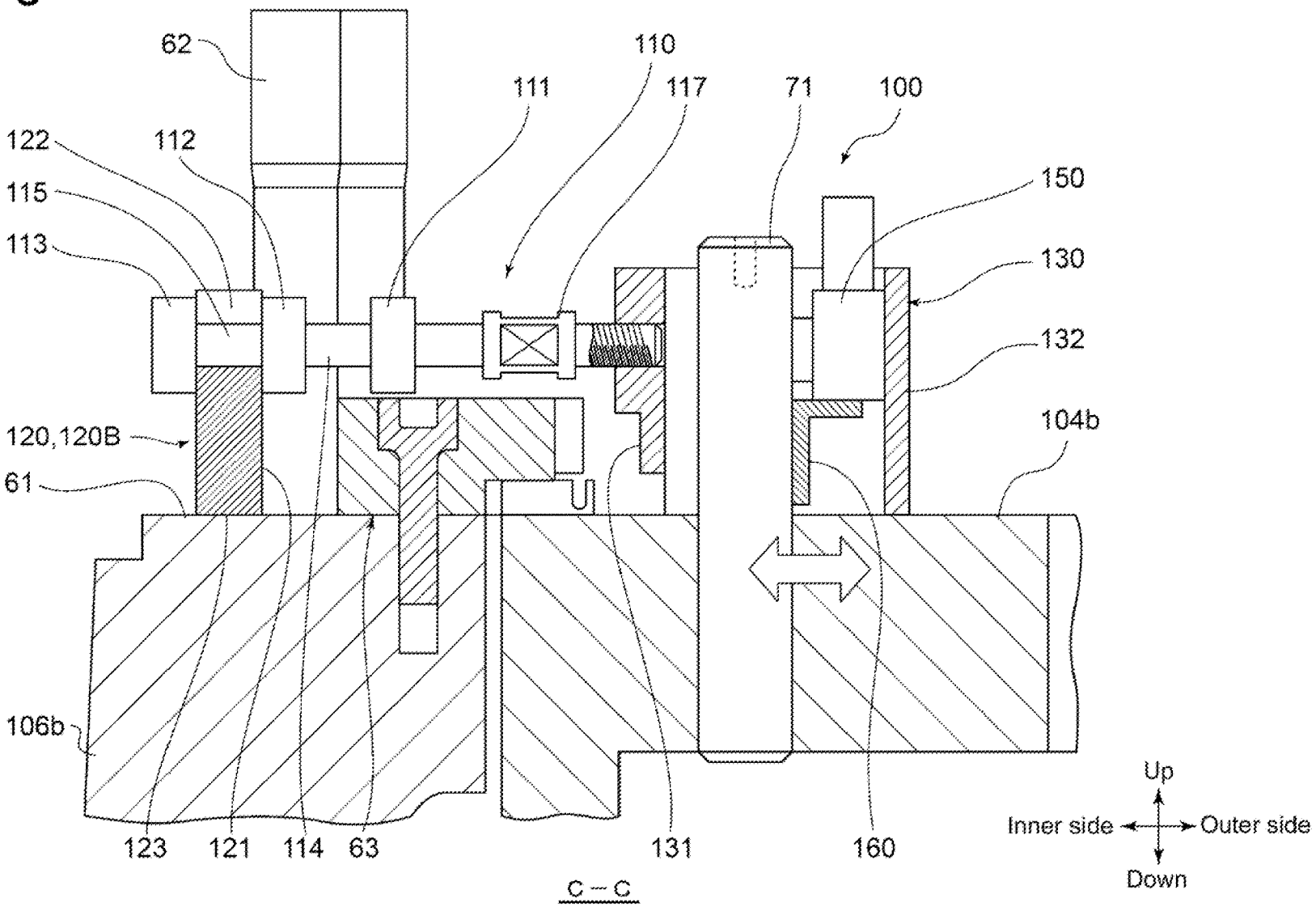
FIG. 9 is a cross-sectional view taken along line C-C in FIG. 8.
Figure 10:
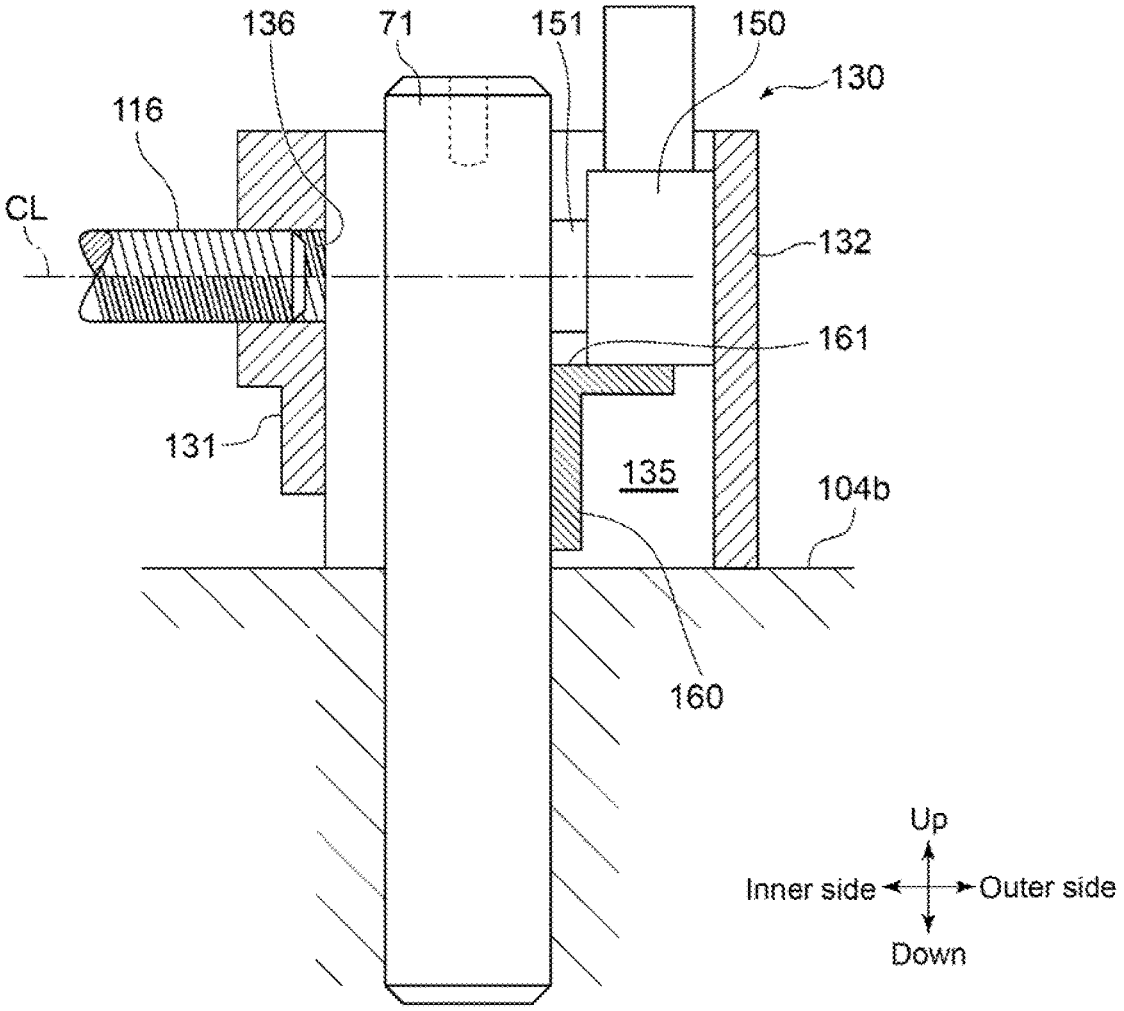
FIG. 10 is a view showing an arrangement state of the jack in FIG. 9.

FIG. 8 is a perspective view showing a state in which positioning of the circumferential end 61 is performed by using the positioning jig 100 according to some embodiments. FIG. 9 is a cross-sectional view taken along line C-C in FIG. 8. FIG. 10 is a view showing an arrangement state of the jack in FIG. 9. FIGS. 8 to 10 are views for describing the case in which the position of the circumferential end 61 is moved toward the radially outer side.

FIGS. 6 and 9 each correspond to an enlarged view of an A portion in FIG. 1.

The positioning method according to some embodiments includes a step of moving the protruding parts 62 disposed at the circumferential end 61 of the blade ring lower half portion 106*b*, which is the arc-like member, in the radial direction with respect to the reference member 71 positioned on the radially outer side as viewed from the circumferential end 61.

The reference member 71 is a member of a shaft form mounted in a bolt hole in the lower half portion 104*b* of the internal casing 104.

In the step of moving the protruding parts 62, the first wall portion 131 and the second wall portion 132, that is, the sleeve 130 is arranged, such that the reference member 71 is positioned between the first wall portion 131 and the second wall portion 132 arranged across the jack accommodation space 135 and connected to each other.

That is, in the step of moving the protruding parts 62, the sleeve 130 is arranged on the upper surface of the lower half portion 104*b* of the internal casing 104, such that the reference member 71 is positioned in the jack accommodation space 135.

In the step of moving the protruding parts 62, before arranging the sleeve 130 on the upper surface of the lower half portion 104*b* of the internal casing 104, it is preferable to mount the rod 110 on the first wall portion 131 by coupling the female screw portion 136 of the first wall portion 131 to the male screw portion 116 of the rod 110. The rod 110 may be mounted on the first wall portion 131 after arranging the sleeve 130 on the upper surface of the lower half portion 104*b* of the internal casing 104.

In the step of moving the protruding parts 62, as shown in FIG. 5, 6, in the case in which the position of the circumferential end 61 is moved toward the radially inner side by using the first pressing piece 120A, it is preferable to arrange the first pressing piece 120A above the circumferential end 61 after arranging the sleeve 130 on which the rod 110 is mounted on the upper surface of the lower half portion 104*b* of the internal casing 104 or after arranging the sleeve 130 on the upper surface of the lower half portion 104*b* of the internal casing 104 and mounting the rod 110 on the sleeve 130.

Moreover, as shown in FIG. 8, 9, in the case in which the position of the circumferential end 61 is moved toward the radially outer side by using the second pressing piece 120B, it is preferable to arrange the second pressing piece 120B on the upper surface of the circumferential end 61 before arranging the sleeve 130 on which the rod 110 is mounted on the upper surface of the lower half portion 104*b* of the internal casing 104.

As shown in FIG. 5, 6, in the case in which the position of the circumferential end 61 is moved toward the radially inner side by using the first pressing piece 120A, the first pressing piece 120A is arranged on radially outer side of the protruding parts 62, with a surface where the pressing recesses 121 are formed in the first pressing piece 120A facing the one end side, that is the radially inner side. Then, the engagement groove 122 of the first pressing piece 120A and the first engagement portion 114 of the rod 110 are engaged with each other.

In a state in which the engagement groove 122 of the first pressing piece 120A and the first engagement portion 114 of the rod 110 are engaged with each other, the radially inner surface of the first large diameter portion 111 and a surface facing the radially outer side in the first pressing piece 120A face each other, and the radially outer surface of the second large diameter portion 112 and a surface facing the radially inner side in the first pressing piece 120A face each other. Thus, radial position displacement between the first pressing piece 120A and the rod 110 is inhibited.

In some embodiments, the first pressing piece 120A is preferably formed such that a lower end 123 thereof abuts on an upper surface 63*a* of a horizontal key 63, when the first pressing piece 120A is engaged with the rod 110. Thus, it is possible to prevent the first pressing piece 120A from rotating about the rod 110, when the first pressing piece 120A is engaged with the rod 110.

The horizontal key 63 is a member for preventing the blade ring lower half portion 106*b* from moving in the circumferential direction.

Moreover, as shown in FIG. 8, 9, in the case in which the position of the circumferential end 61 is moved toward the radially outer side by using the second pressing piece 120B, the second pressing piece 120B is arranged on the radially inner side of the protruding parts 62, with a surface where the pressing recesses 121 are formed in the second pressing piece 120B facing the another end side, that is the radially outer side. Then, the engagement groove 122 of the second pressing piece 120B and the second engagement portion 115 of the rod 110 are engaged with each other.

In a state in which the engagement groove 122 of the second pressing piece 120B and the second engagement portion 115 of the rod 110 are engaged with each other, the radially inner surface of the second large diameter portion 112 and a surface facing the radially outer side in the second pressing piece 120B face each other, and the radially outer surface of the third large diameter portion 113 and a surface facing the radially inner side in the second pressing piece 120B face each other. Thus, radial position displacement between the second pressing piece 120B and the rod 110 is inhibited.

In some embodiments, the second pressing piece 120B is preferably formed such that the second engagement portion 115 of the rod 110 mounted on the sleeve 130 engages with the engagement groove 122, in a state in which the second pressing piece 120B is placed on the upper surface of the circumferential end 61. Thus, a member for supporting the second pressing piece 120B need not additionally be provided, making it possible to reduce the number of components.

In some embodiments, the length of protrusion of the rod 110 from the first wall portion 131 to the radially inner side is adjusted by rotating the male screw portion 116 of the rod 110 with respect to the female screw portion 136 of the sleeve 130, before operating the jack 150 to move the protruding parts 62 with respect to the reference member 71, thereby making it possible to adjust a distance between the first wall portion 131 and the pressing piece 120. That is, in some embodiments, the female screw portion 136 of the sleeve 130 and the male screw portion 116 of the rod 110 constitute an adjustment part for adjusting the length of protrusion of the rod 110.

Thus, it is possible to arrange the pressing piece 120 at a desired position by adjusting the distance between the first wall portion 131 and the pressing piece 120, even if a distance between the protruding parts 62 and the reference member 71 is changed by, for example, deformation in the blade ring lower half portion 106*b*.

In the step of moving the protruding parts 62, the jack 150 is arranged between the reference member 71 and one of the first wall portion 131 or the second wall portion 132 in the jack accommodation space 135. In the case in which the position of the circumferential end 61 is moved toward the radially inner side, as shown in FIGS. 5 to 7, the jack 150 is arranged between the first wall portion 131 and the reference member 71. Moreover, in the case in which the position of the circumferential end 61 is moved toward the radially outer side, as shown in FIGS. 8 to 10, the jack 150 is arranged between the second wall portion 132 and the reference member 71.

In some embodiments, the jack 150 is a hydraulic jack, and is driven by pressurized oil from an external hydraulic pump (not shown). Note that the hydraulic pump may be a manual hydraulic pump or may be a hydraulic pump driven by an electric motor or the like.

When the jack 150 is arranged in the jack accommodation space 135, as shown in FIG. 7, 10, the jack 150 is arranged in the jack accommodation space 135 such that a center axis CL of the rod 110 overlaps at least a part of a piston 151 for the jack 150 as viewed from the extending direction of the rod 110. More specifically, for example, a jack position defining member 160 having an L shape is mounted on the reference member 71, and the jack 150 is placed on the upper surface 161 of the jack position defining member 160, making it possible to decide a height position of the jack 150.

Thus, it is possible to efficiently transmit a pressing force of the jack 150 pressing the first wall portion 131 or the second wall portion 132, making it possible to efficiently transmit the pressing force of the jack 150 to the pressing piece 120.

Note that the jack position defining member 160 may be mounted on the first wall portion 131 or the second wall portion 132, or may be mounted on the jack 150.

Next, in the step of moving the protruding parts 62, the jack 150 is operated to move the protruding parts 62 with respect to the reference member 71 by the pressing piece 120 mounted on the first wall portion 131 via the rod 110.

More specifically, as shown in FIGS. 5 to 7, in the case in which the position of the circumferential end 61 is moved toward the radially inner side by using the first pressing piece 120A, the jack 150 arranged between the first wall portion 131 and the reference member 71 is operated to press the first wall portion 131 toward the radially inner side by a reaction force of the piston 151. Next, it is possible to move the protruding parts 62 toward the radially inner side with respect to the reference member 71 by the first pressing piece 120A mounted on the first wall portion 131 via the rod 110.

In some embodiments, the two pressing recesses 121 are formed in the first pressing piece 120A, and the two pressing recesses 121, respectively, abut on the side surfaces of the two protruding parts 62 arranged in a direction crossing the radial direction to press the protruding parts 62. Thus, in a case in which the protruding parts 62 each serving as a pressing object are moved toward the direction away from the reference member 71, the attitude of the first pressing piece 120A is stabled, making it possible to stably press the protruding parts 62.

As shown in FIGS. 8 to 10, in the case in which the position of the circumferential end 61 is moved toward the radially outer side by using the second pressing piece 120B, the jack 150 arranged between the second wall portion 132 and the reference member 71 is operated to press the second wall portion 132 toward the radially outer side by the reaction force of the piston 151. Thus, it is possible to move the protruding parts 62 toward the radially outer side with respect to the reference member 71 by the second pressing piece 120B mounted on the second wall portion 132 via the rod 110, the first wall portion 131, and the connection portions 133.

In some embodiments, the two pressing recesses 121 are formed in the second pressing piece 120B, and the two pressing recesses 121, respectively, abut on the side surfaces of the two protruding parts 62 arranged in the direction crossing the radial direction to press the protruding parts 62. Thus, in a case in which the protruding parts 62 each serving as the pressing object are moved toward the direction close to the reference member 71, the attitude of the second pressing piece 120B is stabled, making it possible to stably press the protruding parts 62.

As shown in FIGS. 8 to 10, in the case in which the position of the circumferential end 61 is moved toward the radially outer side by using the second pressing piece 120B, since it is possible to arrange the rod 110 between the two protruding parts 62 arranged in the direction crossing the radial direction, it is possible to arrange the rod 110 in a narrow place.

That is, in the above-described positioning method according to some embodiments, in the step of moving the protruding parts 62, the wall portion 131, 132 (that is, the first wall portion 131 or the second wall portion 132) is arranged on the radially inner side or the radially outer side with respect to the reference member 71. Then, the jack 150 is disposed between the reference member 71 and the wall portion 131, 132 (that is, the first wall portion 131 or the second wall portion 132). Then, the jack 150 is operated to move the protruding parts 62 with respect to the reference member 71 by the pressing piece 120 mounted on the wall portion 131, 132 (that is, the first wall portion 131 or the second wall portion 132) via the rod 110.

With the above-described positioning method according to some embodiments, since the jack 150 is operated to move the protruding parts 62 with respect to the reference member 71 by the pressing piece 120 mounted on the first wall portion 131 via the rod 110, positioning of the blade ring lower half portion 106*b* is easily performed.

Moreover, with the above-described positioning method according to some embodiments, depending on whether the jack 150 is arranged between the first wall portion 131 and the reference member 71 or whether the jack 150 is arranged between the second wall portion 132 and the reference member 71 in the jack accommodation space 135, it is possible to change whether the pressing piece 120 is moved to the radially inner side or moved to the radially outer side. Thus, it is possible to move the protruding parts 62 to both of the radially inner side and the radially outer side with respect to the reference member 71.

Figure 11:
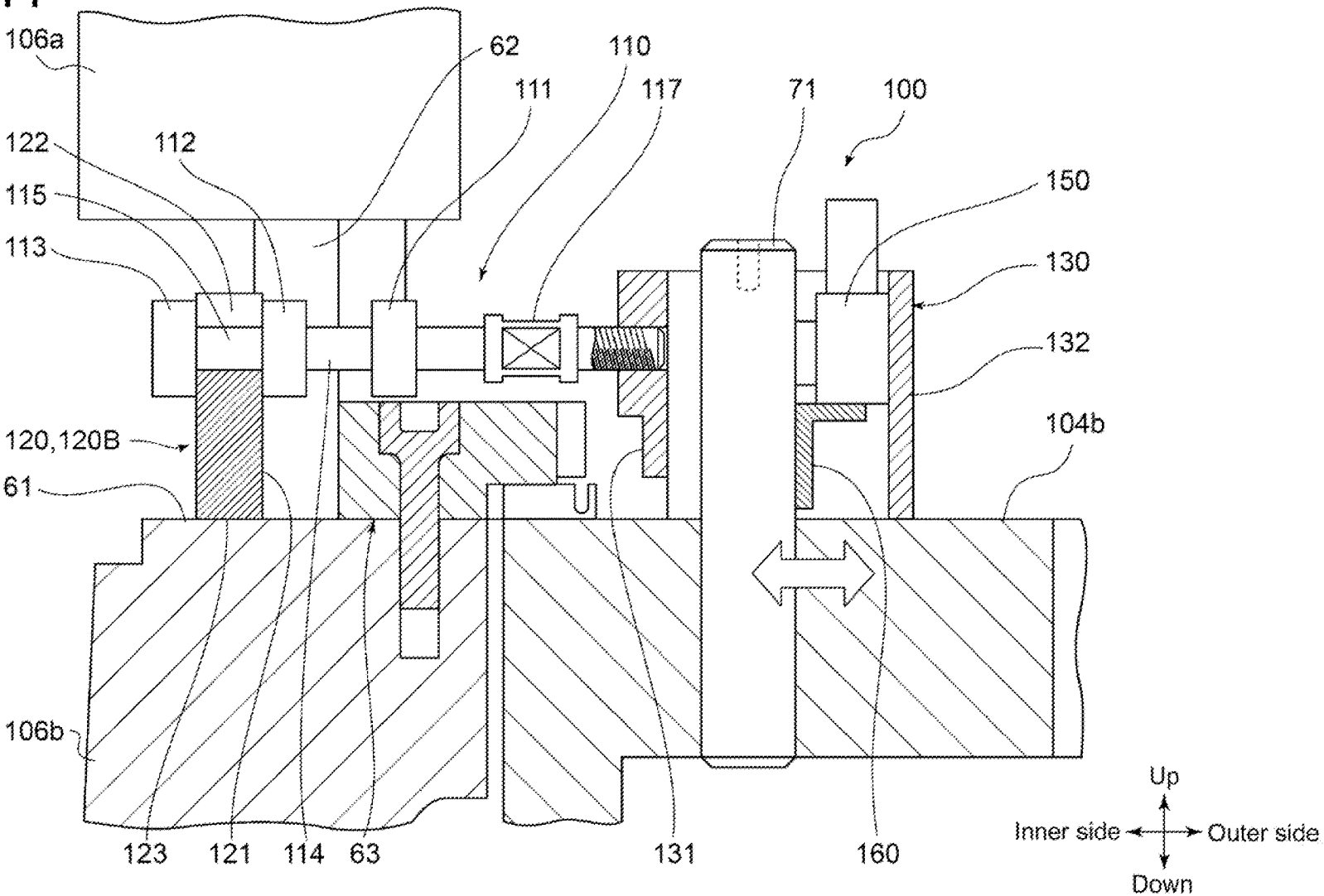
FIG. 11 is a view for describing a case in which protruding parts are moved to a radially outer side to perform positioning, and then the blade ring upper half portion is disposed on top of each of the protruding parts.

In some embodiments described above, the second pressing piece 120B is configured to be detachable with respect to the rod 110, and does not cover the entire circumference of each of the protruding parts 62 along the circumferential direction. Thus, for example, as shown in FIG. 11, even if the blade ring upper half portion 106*a* and a dummy blade ring are arranged on top of each of the protruding parts 62 after the protruding parts 62 are moved to the radially outer side to perform positioning, it is possible to dismount the second pressing piece 120B and the rod 110 to be removed. Thus, it is possible to move the protruding parts 62 to the radially outer side, even in a work of arranging the blade ring upper half portion 106*a* and the dummy blade ring. FIG. 11 is a view for describing a case in which the protruding parts 62 are moved to the radially outer side to perform positioning, and then the blade ring upper half portion 106*a* is arranged on top of each of the protruding parts 62.

The present invention is not limited to the above-described embodiments, and also includes an embodiment obtained by modifying the above-described embodiments and an embodiment obtained by combining these embodiments as appropriate.

Figure 12:
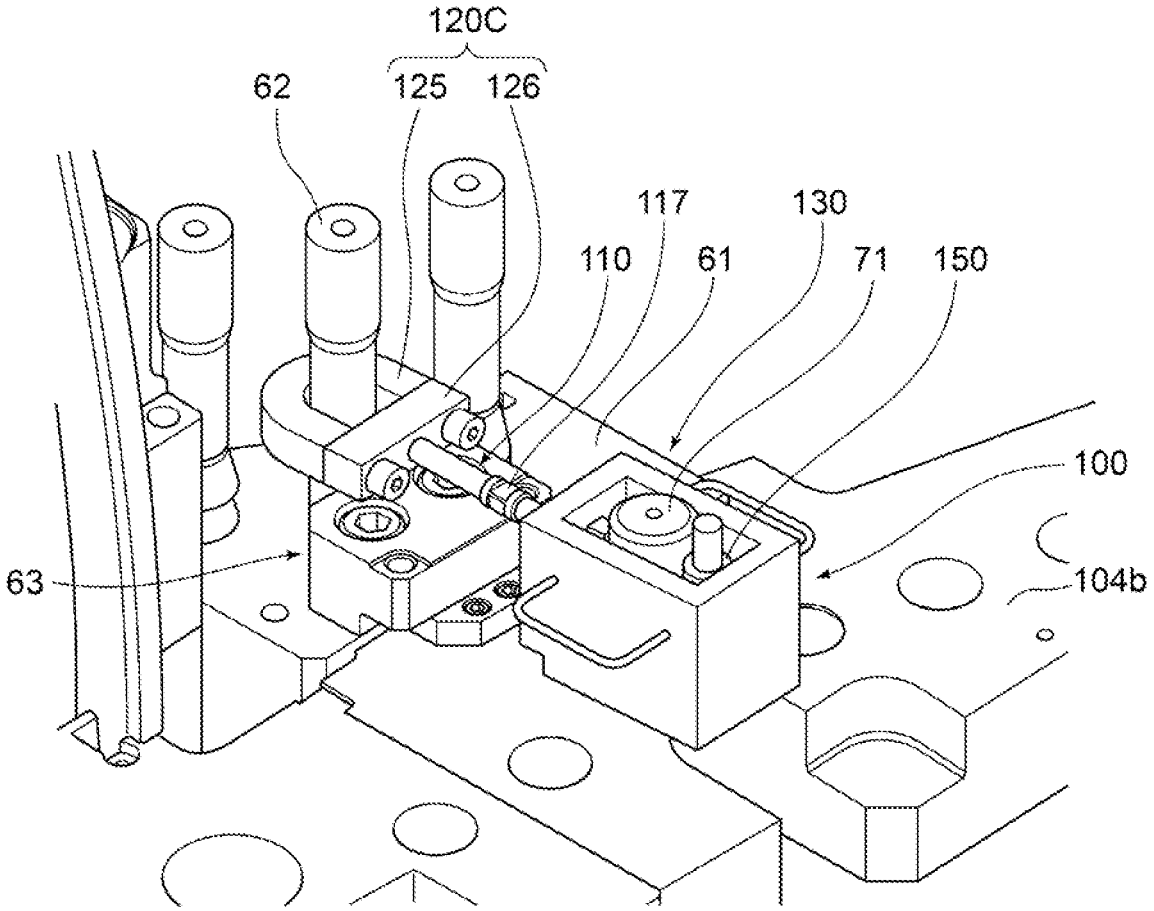
FIG. 12 is a view for describing a modified example.

For example, the form of the pressing piece 120 in some embodiments described above is an example, and the present invention is not limited thereto. For example, as shown in FIG. 12, a third pressing piece 120C may be configured to include a U-shaped portion 125 having a U shape and a both end coupling portion 126 formed so as to close both ends of the U-shaped portion 125. As shown in FIG. 12, the U-shaped portion 125 is arranged such that the protruding part 62 is positioned in an inner peripheral portion of the U-shaped portion 125, and the U-shaped portion 125 and the both end coupling portion 126 are coupled, thereby making it possible to cover the entire circumference of the protruding part 62. Moreover, the both end coupling portion 126 is connected to one end portion of the rod 110. Thus, it is possible to operate the jack 150 to move the protruding part 62 to the radially inner side and the radially outer side with respect to the reference member 71 by the third pressing piece 120C mounted on the first wall portion 131 via the rod 110.

Note that as shown in FIG. 11, even in the state in which blade ring upper half portion 106*a* is arranged on top of the protruding part 62, it is possible to dismount the third pressing piece 120C from the protruding part 62 by releasing the coupling between the U-shaped portion 125 and the both end coupling portion 126.

Figure 13:
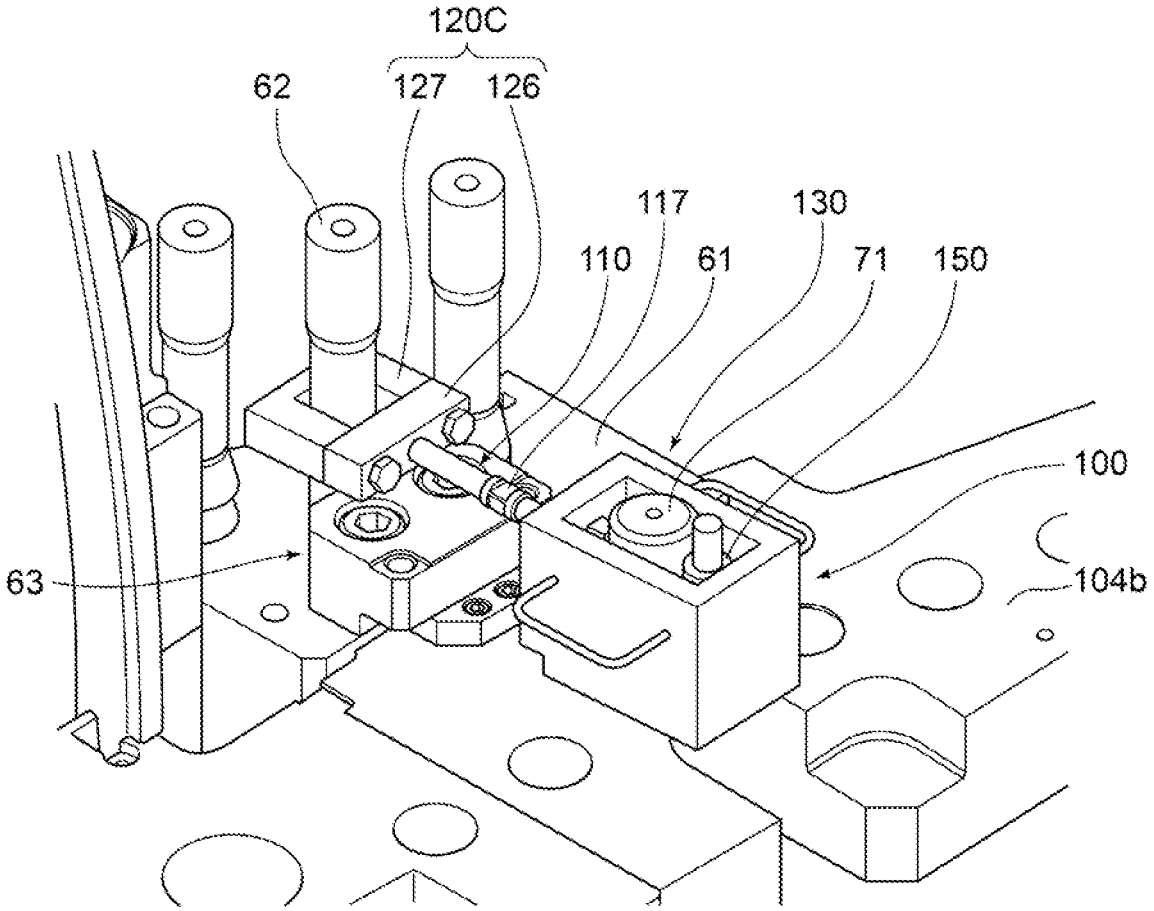
FIG. 13 is a view for describing a modified example.

In place of the U-shaped portion 125 shown in FIG. 12, as shown in FIG. 13, a member 127 of a frame shape corresponding to three sides of a rectangle may be used.

In some embodiments described above, the object to undergo positioning is the blade ring 106. However, the present invention is not limited thereto. For example, an intermediate shaft cover in the gas turbine also has an upper half portion and a lower half portion each having an arc-like shape, and is considered to be deformed in the same manner as oval deformation in the blade ring 106 described above. Therefore, the positioning jig 100 and the positioning method according to some embodiments described above may be applied to positioning of the intermediate shaft cover.

In some embodiments described above, the sleeve 130 includes the first wall portion 131, the second wall portion 132, and the connection portions 133, and has a rectangular shape in the planar view. However, the present invention is not limited thereto. For example, at least one of the first wall portion 131, the second wall portion 132, and the connection portions 133 may have a curved portion in the planar view. Note that the sleeve 130 only needs to include at least a pressed member configured to be pressed by the jack 150, such as a member corresponding to the above-described first wall portion 131 or second wall portion 132, and the pressed member can have any shape. Moreover, as long as the pressed member is configured to be mountable on the another end portion of the rod 110 and is configured to be able to transmit the reaction force of the piston 151 to the rod 110, a connection part between the pressed member and the other end of the rod 110 can have any shape.

In some embodiments described above, the protruding parts 62 are moved toward the radially inner side or the radially outer side with respect to the reference member 71 by pressing the first wall portion 131 or the second wall portion 132 with the jack 150, by using the sleeve 130 including the first wall portion 131 and the second wall portion 132 each serving as the wall portion, and the connection portions 133. However, using the positioning jig which includes the rod 110, the pressing piece 120 mounted on one end portion of the rod 110, and the wall portion mounted on the another end portion of the rod 110, instead of the positioning jig 100 including the sleeve 130 described above, positioning of the pressing object with respect to the reference member 71 may be performed.

Figure 14:
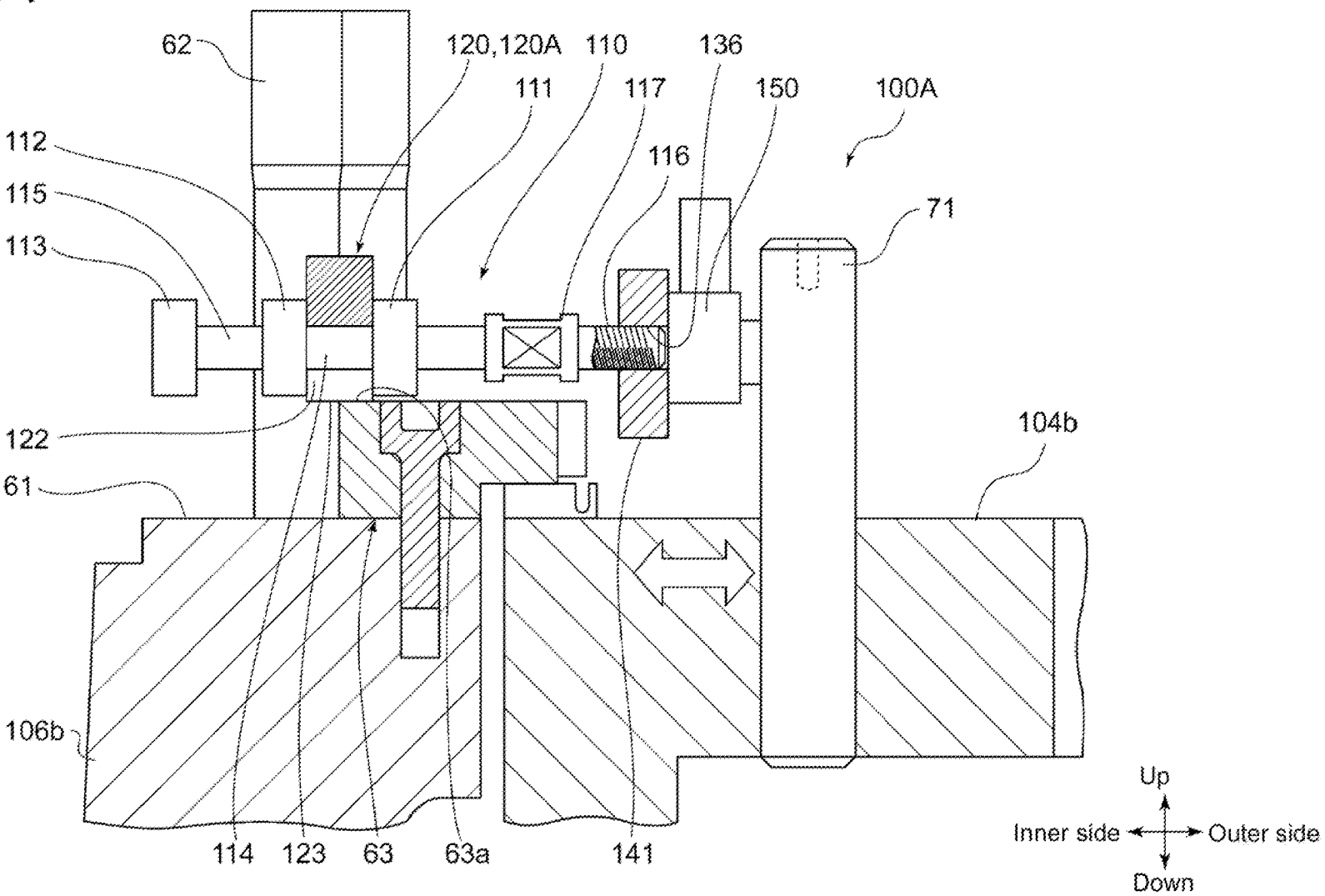
FIG. 14 is a view for describing another form of a positioning jig.

FIG. 14 is a view for describing a case in which the pressing object is moved toward the direction away from the reference member 71, by using a positioning jig 100A which includes the rod 110, the pressing piece 120 mounted on one end portion of the rod 110, and a wall portion 141 mounted on the another end portion of the rod 110.

Figure 15:
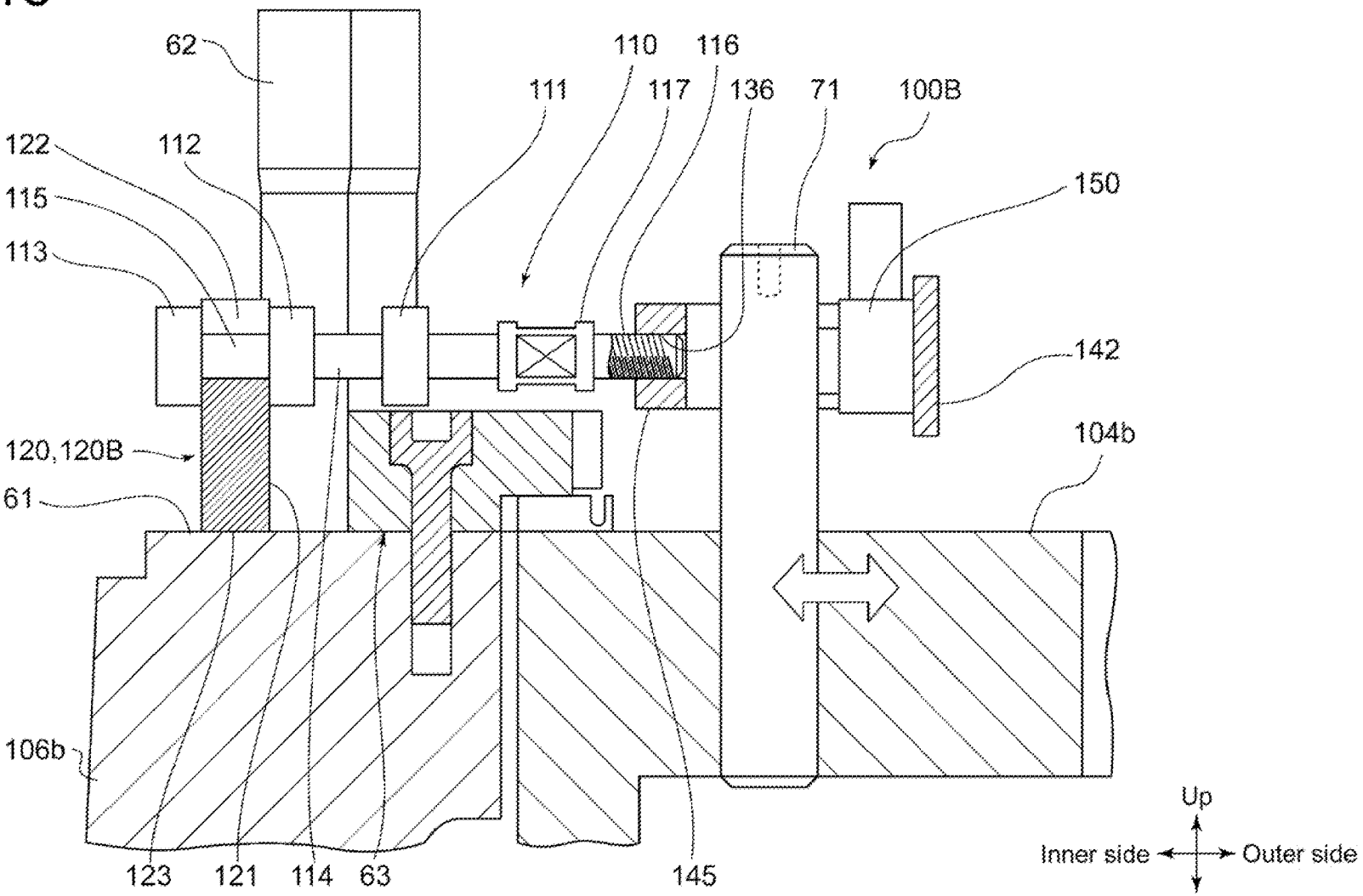
FIG. 15 is a view for describing another form of a positioning jig.

FIG. 15 is a view for describing a case in which the pressing object is moved toward the direction close to the reference member 71, by using a positioning jig 100B which includes the rod 110, the pressing piece 120 mounted on one end portion of the rod 110, and a wall portion 142 mounted on the another end portion of the rod 110.

In the positioning jig 100A shown in FIG. 14, the wall portion 141 is a pressed member configured to be pressed by the jack 150, as with the above-described first wall portion 131 and second wall portion 132. The wall portion 141 is configured to be mountable on the another end portion of the rod 110. For example, the wall portion 141 preferably includes the female screw portion 136 formed to be coupled to the male screw portion 116 of the rod 110, as with the above-described first wall portion 131.

In the positioning method of the arc-like member using the positioning jig 100A shown in FIG. 14, in the step of moving the protruding parts 62, the wall portion 141 is arranged on the radially inner side with respect to the reference member 71. Then, the jack 150 is disposed between the wall portion 141 and the reference member 71.

Then, the jack 150 is operated to move the protruding parts 62 toward the radially inner side with respect to the reference member 71 by the pressing piece 120 (first pressing piece 120A) mounted on the wall portion 141 via the rod 110.

More specifically, the jack 150 arranged between the wall portion 141 and the reference member 71 is operated to press the wall portion 141 toward the radially inner side by the reaction force of the piston 151. Thus, it is possible to move the protruding parts 62 toward the radially inner side with respect to the reference member 71 by the first pressing piece 120A mounted on the wall portion 141 via the rod 110.

In the positioning jig 100B shown in FIG. 15, the wall portion 142 is a pressed member configured to be pressed by the jack 150, as with the above-described first wall portion 131 and second wall portion 132. The wall portion 142 is configured to be mountable on the another end portion of the rod 110. For example, the wall portion 142 is preferably connected to a female screw member 145 formed to be coupled to the male screw portion 116 of the rod 110.

In the positioning method of the arc-like member using the positioning jig 100B shown in FIG. 15, in the step of moving the protruding parts 62, the wall portion 142 is arranged on the radially outer side with respect to the reference member 71. Then, the jack 150 is arranged between the wall portion 142 and the reference member 71.

Then, the jack 150 is operated to move the protruding parts 62 to the radially outer side with respect to the reference member 71 by the pressing piece 120 (second pressing piece 120B) mounted on the wall portion 142 via the rod 110.

More specifically, the jack 150 disposed between the wall portion 142 and the reference member 71 is operated to press the wall portion 142 toward the radially outer side by the reaction force of the piston 151. Thus, it is possible to move the protruding parts 62 toward the radially outer side with respect to the reference member 71 by the second pressing piece 120B mounted on the wall portion 142 via the rod 110 and the female screw member 145.

Note that the wall portion 141, 142 only needs to be configured to be pressed by the jack 150, and the wall portion 141, 142 can have any shape. That is, for example, the wall portion 141, 142 may have a curved portion in the planar view.

Moreover, as long as the wall portion 141, 142 is configured to directly or indirectly be mountable on the another end portion of the rod 110 and is configured to be able to transmit the reaction force of the piston 151 to the rod 110, a connection part between the wall portion 141, 142 and the other end of the rod 110 can have any shape.

For example, the wall portion 141, 142 may be configured such that a lower end thereof abuts on the upper surface of the lower half portion 104*b*, as with the above-described sleeve 130, when arranged on the radially inner side or radially outer side with respect to the reference member 71. Thus, the wall portion 141, 142 is stable in attitude, when arranged on the radially inner side or radially outer side with respect to the reference member 71.

Moreover, although not shown in FIGS. 14 and 15, the height position of the jack 150 may be decided by mounting the jack position defining member 160 on the reference member 71 and placing the jack 150 on the upper surface 161 of the jack position defining member 160, as shown in FIGS. 6 and 9, for example.

Note that in some embodiments described above, the jack position defining member 160 need not necessarily be configured to be mountable on the reference member 71, but may be configured to be placed on the upper surface of the lower half portion 104*b*, may be configured to be fixable to the upper surface of the lower half portion 104*b*, and may be configured to be mountable on the jack 150. Moreover, the jack position defining member 160 may be configured to be detachable to the sleeve 130 and the wall portion 141, 142, and may be disposed on the sleeve 130 and the wall portion 141, 142 in advance.

REFERENCE SIGNS LIST

61 Circumferential end
62 Protruding part
71 Reference member
100, 100A, 100B Positioning jig
104 Internal casing
106 Blade ring
106*a* Blade ring upper half portion
106*b* Blade ring lower half portion
110 Rod
114 First engagement portion
115 Second engagement portion
116 Male screw portion
120 Pressing piece
120A First pressing piece
120B Second pressing piece
120C Third pressing piece
121 Pressing recess

122 Engagement groove
130 Sleeve
131 First wall portion (wall portion)
132 Second wall portion (wall portion)
133 Connection portion
135 Jack accommodation space
136 Female screw portion
141, 142 Wall portion

The invention claimed is:

1. A positioning method of an arch shape structure, the positioning method comprising:

a step of moving a protruding part disposed at a circumferential end of the arch shape structure in a radial direction with respect to a reference member positioned on a radially outer side as viewed from the circumferential end of the arch shape structure, wherein in the step of moving the protruding part:

a wall portion is arranged on a radially outer side or a radially inner side with respect to the reference member;

a jack is arranged between the wall portion and the reference member; and the jack is operated to move the protruding part with respect to the reference member by a pressing piece mounted on the wall portion via a rod.

2. The positioning method of the arch shape structure according to claim 1, wherein in the step of moving the protruding part:

a first wall portion and a second wall portion connected to each other are arranged, such that the reference member is positioned between the first wall portion and the second wall portion;

the jack is arranged between the reference member and one of the first wall portion or the second wall portion; and the jack is operated to move the protruding part with respect to the reference member by the pressing piece mounted on the first wall portion via the rod.

3. The positioning method of the arch shape structure according to claim 2, wherein in the step of moving the protruding part:

the jack is arranged between the first wall portion and the reference member;

the pressing piece is arranged on the radially outer side of the protruding part; and the jack is operated to move the protruding part toward the radially inner side with respect to the reference member by the pressing piece mounted on the first wall portion via the rod.

4. The positioning method of the arch shape structure according to claim 2, wherein in the step of moving the protruding part:

the jack is arranged between the second wall portion and the reference member;

the pressing piece is arranged on the radially inner side of the protruding part; and the jack is operated to move the protruding part toward the radially outer side with respect to the reference member by the pressing piece mounted on the first wall portion via the rod.

5. The positioning method of the arch shape structure according to claim 4, wherein in the step of moving the protruding part:

the jack is arranged such that a center axis of the rod overlaps at least a part of a piston for the jack, as viewed in an extending direction of the rod.

6. The positioning method of the arch shape structure according to claim 5, wherein in the step of moving the protruding part:

a distance between the first wall portion and the pressing piece is adjusted by adjusting a length of protrusion of the rod from the first wall portion to the radially inner side, before the jack is operated to move the protruding part with respect to the reference member by the pressing piece mounted on the first wall portion via the rod.

7. A positioning jig comprising:

a rod;

a pressing piece mounted on one end portion of the rod;

a first wall portion mounted on another end portion of the rod; and a second wall portion positioned opposite to the rod across the first wall portion in an axial direction of the rod, and connected to the first wall portion, wherein the first wall portion and the second wall portion form a jack accommodation space between the first wall portion and the second wall portion in the axial direction, wherein the pressing piece is configured to be detachable with respect to the rod, and wherein the rod includes:

a first engagement portion engaged with the pressing piece mounted on the first wall portion via the rod, in a case in which the jack arranged in the jack accommodation space is operated to move an object in a direction away from a reference member positioned in the jack accommodation space by the pressing piece; and a second engagement portion engaged with the pressing piece mounted on the first wall portion via the rod, in a case in which the jack arranged in the jack accommodation space is operated to move the object in a direction toward the reference member positioned in the jack accommodation space by the pressing piece.

8. The positioning jig according to claim 7, wherein the pressing piece includes a pressing recess formed in a surface abutting on the object, engages the surface toward a side of the one end portion when engaged with the first engagement portion, and engages the surface toward a side of the another end portion when engaged with the second engagement portion.

9. The positioning jig according to claim 8, further comprising:

a jack position defining member for arranging the jack in the jack accommodation space, wherein the jack includes a piston, and the jack position defining member positions the jack such that a center axis of the rod overlaps at least a part of the piston as viewed in an extending direction of the rod.

10. The positioning jig according to claim 9, further comprising:

an adjustment part for adjusting a length of protrusion of the rod from the first wall portion in the axial direction.

11. A positioning jig comprising:

a rod;

a pressing block mounted on a first end portion of the rod;

a first wall portion mounted on a second end portion of the rod;

a second wall portion connected to the first wall portion, the second wall portion being positioned on an opposite side of the first wall portion relative to rod in an axial direction of the rod, wherein the first wall portion and the second wall portion form a jack accommodation space between the first wall portion and the second wall portion in the axial direction;

a jack disposed in the jack accommodation space and having a piston; and a jack position defining member for arranging the jack in the jack accommodation space such that a center axis of the rod overlaps at least a part of the piston as viewed in an extending direction of the rod.

* * * * *